US012012250B2

(12) United States Patent
Morris, Jr.

(10) Patent No.: US 12,012,250 B2
(45) Date of Patent: Jun. 18, 2024

(54) CONTAINER WITH SIDEWALL PILLARS

(71) Applicant: Glenn H. Morris, Jr., Chattanooga, TN (US)

(72) Inventor: Glenn H. Morris, Jr., Chattanooga, TN (US)

( * ) Notice: Subject to any disclaimer, the term of this patent is extended or adjusted under 35 U.S.C. 154(b) by 395 days.

(21) Appl. No.: 16/891,172

(22) Filed: Jun. 3, 2020

(65) Prior Publication Data

US 2020/0385161 A1 Dec. 10, 2020

Related U.S. Application Data

(60) Provisional application No. 62/858,377, filed on Jun. 7, 2019.

(51) Int. Cl.

| | |
|---|---|
| ***B65D 1/22*** | (2006.01) |
| ***B65D 1/26*** | (2006.01) |
| ***B65D 1/40*** | (2006.01) |
| ***B65D 1/42*** | (2006.01) |
| ***B65D 1/44*** | (2006.01) |

(52) U.S. Cl.

CPC ..... *B65D 1/42* (2013.01); *B65D 1/22* (2013.01); *B65D 1/44* (2013.01)

(58) Field of Classification Search

CPC ... B65D 1/42; B65D 1/44; B65D 1/22; B65D 1/26; B65D 1/34

USPC ..... 220/608, 669–673, 668, 675, 532; D9/425, 341, 345, 348, 424, 429, 432; 206/518; 229/407; D3/304

See application file for complete search history.

(56) References Cited

U.S. PATENT DOCUMENTS

| | | | | | |
|---|---|---|---|---|---|
| 177,114 | A | * | 5/1876 | Gilbert | A21B 3/13 220/62.1 |
| 236,518 | A | * | 1/1881 | Vivarttas | B65D 13/04 229/125.17 |
| 2,262,642 | A | * | 11/1941 | Liberson | A63F 9/0406 220/675 |
| 2,813,656 | A | * | 11/1957 | Anderson | B65D 21/046 206/507 |
| 2,918,379 | A | * | 12/1959 | Lurie | B65D 81/262 220/675 |
| 2,985,333 | A | * | 5/1961 | Kirkman | A47B 88/90 220/533 |
| 3,140,807 | A | * | 7/1964 | Bostrom | B65D 1/26 229/406 |
| D200,264 | S | * | 2/1965 | Tudor | D3/310 |
| 3,194,468 | A | * | 7/1965 | Baron | B65D 1/265 220/675 |
| D207,354 | S | * | 4/1967 | Sulger | 229/407 |
| 3,734,341 | A | * | 5/1973 | Levenhagen | B65D 21/045 211/126.7 |
| D228,263 | S | * | 8/1973 | Jones | D3/307 |
| 3,901,406 | A | * | 8/1975 | Kivett | B65D 43/0222 220/675 |

(Continued)

*Primary Examiner* — Gideon R Weinerth

(74) *Attorney, Agent, or Firm* — Miller & Martin PLLC; Stephen J. Stark

(57) ABSTRACT

A container has a base with upwardly extending sidewalls forming an enclosed volume. A plurality of spaced apart pillars extend from toward the base to toward an upper edge of the sidewalls along the sidewalls. The pillars may have a plurality of supports forming each of the pillars. The pillars provide additional stacking strength to the container without significantly contributing to the weight of the container.

14 Claims, 3 Drawing Sheets

(56) References Cited

U.S. PATENT DOCUMENTS 3,944,124 A * 3/1976 Hexel ..... B65D 1/265 220/675
D247,645 S * 3/1978 Woodhall ..... D6/629
4,195,746 A * 4/1980 Cottrell ..... B65D 1/34 428/116
D274,205 S * 6/1984 Kates ..... D6/705
D274,967 S * 8/1984 Taylor ..... D3/304
D282,883 S * 3/1986 Kiiski ..... D3/304
4,616,762 A * 10/1986 Alexander ..... A47J 36/022 220/573.1
4,722,453 A * 2/1988 Hamilton ..... B42F 17/12 206/425
4,753,351 A * 6/1988 Guillin ..... B65D 1/42 206/520
4,819,795 A * 4/1989 Swaney ..... B65D 21/0233 206/508
4,932,532 A * 6/1990 Apps ..... B65D 71/70 220/519
D311,624 S * 10/1990 O'Leary ..... D3/304
D311,800 S * 10/1990 Kiiski ..... D3/304
D313,493 S * 1/1991 Apps ..... B65D 15/04 D3/313
D318,420 S * 7/1991 Amelse ..... D9/425
D336,850 S * 6/1993 Guillin ..... B65D 43/0222 D9/425
5,348,151 A * 9/1994 Dressen ..... G11B 33/0466 211/41.12
D356,680 S * 3/1995 Edgerton, Jr. ..... D3/313
D368,584 S * 4/1996 Stommel, Jr. ..... D9/425
5,507,390 A * 4/1996 Vila ..... B65D 5/324 206/557
5,515,993 A * 5/1996 McManus ..... B65D 43/162 206/508
D378,734 S * 4/1997 Hardy ..... B65D 21/046 D9/425
D398,526 S * 9/1998 Schwarz ..... D9/425
D430,800 S * 9/2000 Sarnoff ..... B65D 21/0233 D9/425
6,293,458 B1 * 9/2001 Sarnoff ..... A47J 36/022 220/573.1
D517,318 S * 3/2006 Ruybal ..... B42F 17/12 D3/273
D572,904 S * 7/2008 Beckerman ..... D3/304
D577,994 S * 10/2008 Kessell ..... D9/425
D588,937 S * 3/2009 Pelletier ..... A45F 3/20 D9/781
7,922,001 B2 * 4/2011 Meers ..... B65D 21/045 206/505
D660,692 S * 5/2012 Haupert ..... D9/424
D685,628 S * 7/2013 Durdon ..... D9/425
D747,962 S * 1/2016 Astorga ..... A47J 27/16 D9/425
D759,479 S * 6/2016 Das ..... B65D 21/045 D9/425
D866,971 S * 11/2019 Wang ..... D3/304
D885,187 S * 5/2020 Sill ..... D9/456
10,814,375 B2 * 10/2020 Sarnoff ..... A47J 27/16
D937,672 S * 12/2021 Bontrager ..... B65D 1/42 D9/425
D953,163 S * 5/2022 Sill ..... A47B 88/90 D9/425
11,390,415 B2 * 7/2022 Apps ..... B65D 1/243
2003/0192897 A1 * 10/2003 Stapleton ..... B65D 1/40 220/674
2006/0138152 A1 * 6/2006 Pelletier ..... B65D 21/0233 220/675
2008/0264939 A1 * 10/2008 Bray ..... B65D 15/04 220/276
2009/0285929 A1 * 11/2009 Diamantakos ..... B65D 1/26 428/34.1
2012/0000920 A1 * 1/2012 Anhalt ..... B65D 1/44 220/608
2012/0318810 A1 * 12/2012 Hodge ..... A45F 3/20 206/515
2013/0068654 A1 * 3/2013 MacDonald ..... B65D 47/043 220/268
2014/0103038 A1 * 4/2014 Wnek ..... B65D 1/42 493/162
2014/0190861 A1 * 7/2014 Carrel ..... B01L 9/06 206/518
2015/0060471 A1 * 3/2015 Poehls ..... B29C 45/0046 220/675
2020/0385161 A1 * 12/2020 Morris, Jr. ..... B65D 1/22
2020/0407920 A1 * 12/2020 Chung ..... B65D 1/42
2022/0371807 A1 * 11/2022 Hutterer ..... B65B 5/06

* cited by examiner

CONTAINER WITH SIDEWALL PILLARS

CLAIM OF PRIORITY

This application claims the benefit of U.S. Provisional Patent Application No. 62/858,377 filed Jun. 7, 2019 which is incorporated herein by reference in its entirety.

FIELD OF THE INVENTION

The present invention relates to containers having upwardly extending sidewalls and more particularly to plastic containers having strengthened sidewall constructions which can provide for increased stacking strength while minimizing materials.

BACKGROUND OF THE INVENTION

There have been consistent efforts over the years to provide containers having thin sidewalk yet improved strength characteristics particularly for stacking applications. U.S. Pat. No. 8,256,640 provides a diamond style patterns to sidewalk in an effort to minimize the thickness while increasing strength. Many other efforts have been done in this regard as well including U.S. Pat. No. 4,844,05 which has increased thickness mell chambers along sidewalls in spaced locations. U.S. Published Patent Application No. 2004/0060942 has a continuous corrugation style wall formed about its exterior wall surface. U.S. Pat. No. 5,305,911 describes a faceted container having a plurality of angled exterior sidewall surfaces in an effort to provide increased strength. Other efforts include U.S. Pat. No. 4,446,969 as well as U.S. Pat. No. 3,362,576 which provide various corrugated and/or angular shaped sidewalk in an effort to provide increased stacking strength.

While all these designs improve over the basic extremely thin walled sidewall surfaces in order to provide increased stacking strength, the applicant believes still further improvements can be achieved in this crowded art.

SUMMARY OF THE INVENTION

It is an object of many embodiments of the present invention to provide an improved container having spaced apart strengthening pillars:

It is another object of many embodiments of the present invention to provide an improved container having strengthening members disposed thereabout:

It is another object of many embodiments of the present invention to provide an improved container:

It is another object of many embodiments to provide improved container having an exterior smooth surface while providing internally extending stiffening members at predetermined locations in an effort to strengthen the container, particularly in regard to stacking strength, while still minimizing the thickness of the sidewalls and thus material utilized, for many embodiments.

Accordingly, in accordance with many embodiments of the present invention, a container is provided having a base and one or more sidewalk integrally formed with and extending upwardly from the base. The sidewalk surround an internal cavity and one or more of the sidewall portions include reinforcing pillars having a plurality of increased wall thickness portions vertically extending along the sidewalls up towards a top opening.

For many embodiments of the present invention, a container provides a plastic injection molded container having at least a plurality of pillars which could be disposed along planar and/or around sidewall portions (such as at corners or curves of the sidewall) preferably in a spaced apart manner whereby the pillars are spaced apart and separated by thin walled sidewall portions whereby the pillars are substantially vertically extending and preferably provide a series of strengthening members extending in a vertical manner. The pillars (with their multiple supports) extend from towards the bottom of the pail to towards the upper edge and for many embodiments may be somewhat triangular or rounded in cross shape extending into the cavity of the container toward a narrower or pointed portion from a wider base to provide a series of ridges which can be essentially co-planar with the interior wall portions which space apart the pillars.

The pillars can be constructed so as to not extend completely through the sidewall, so the exterior surface of the sidewall may be smooth. This is different than the corrugated prior art construction. Not only can planar sidewall portions be provided with spaced apart pillars, but also the corners or other curved sidewall portions can have pillars rounded about a radius and/or through a corner so as to provide additional strength at the corners and/or other locations while still being spaced apart from other pillars and/or other sidewall portions. For a substantially rectangular container having rounded corners, this could be a particularly effective way at increasing the stacking strength while not provide significantly more material in an effort to minimize the total amount of material utilized to make what is typically an injection molded pail.

BRIEF DESCRIPTION OF THE DRAWINGS

Particular features and advantages of the present invitation will become apparent from the following description when considered in conjunction with the accompanying drawings in which.

DETAILED DESCRIPTION FOR PREFERRED EMBODIMENTS

Figure 1:
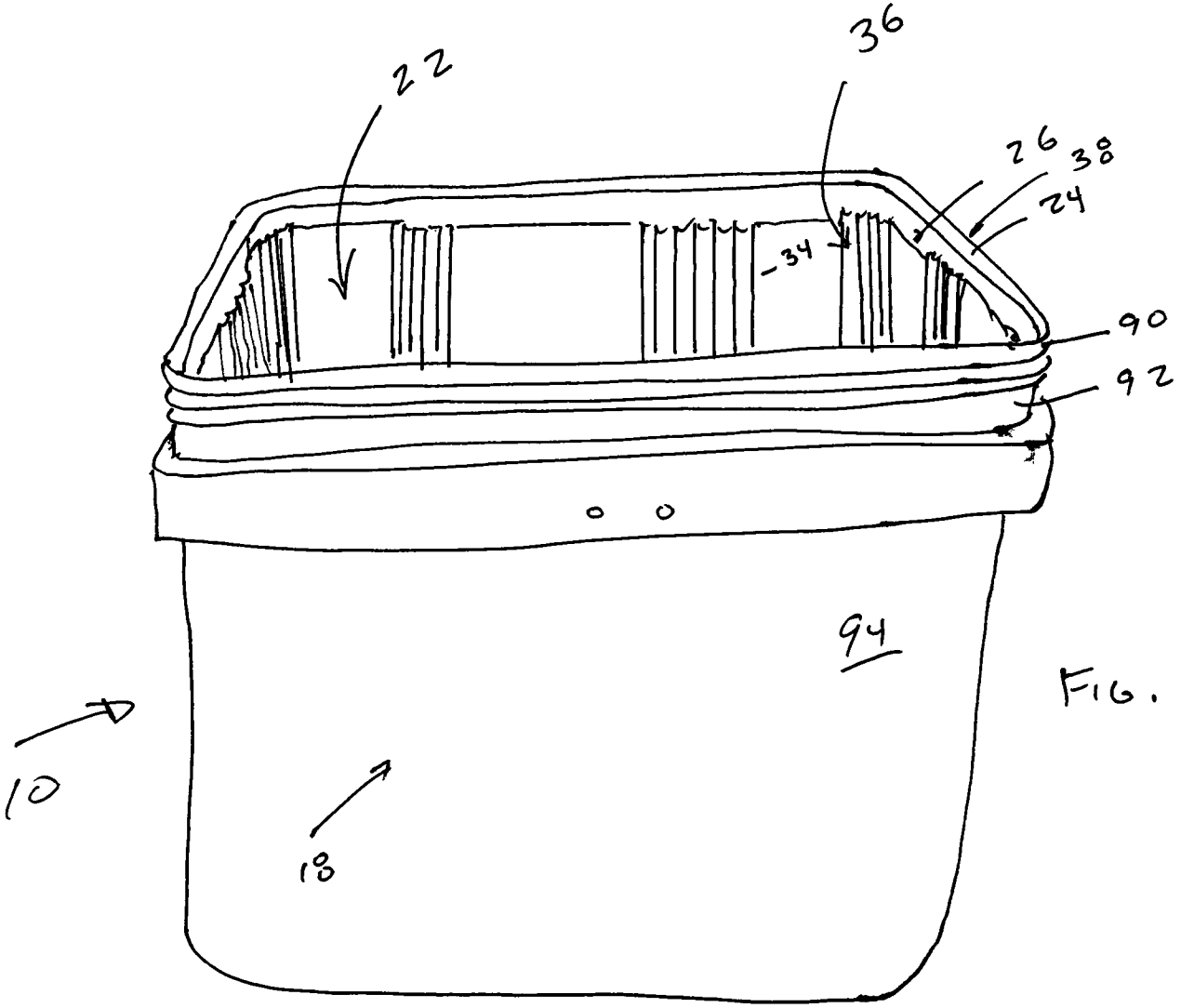
FIG. 1 is a side perspective view of the presently preferred embodiment of the present invention.
Figure 2:
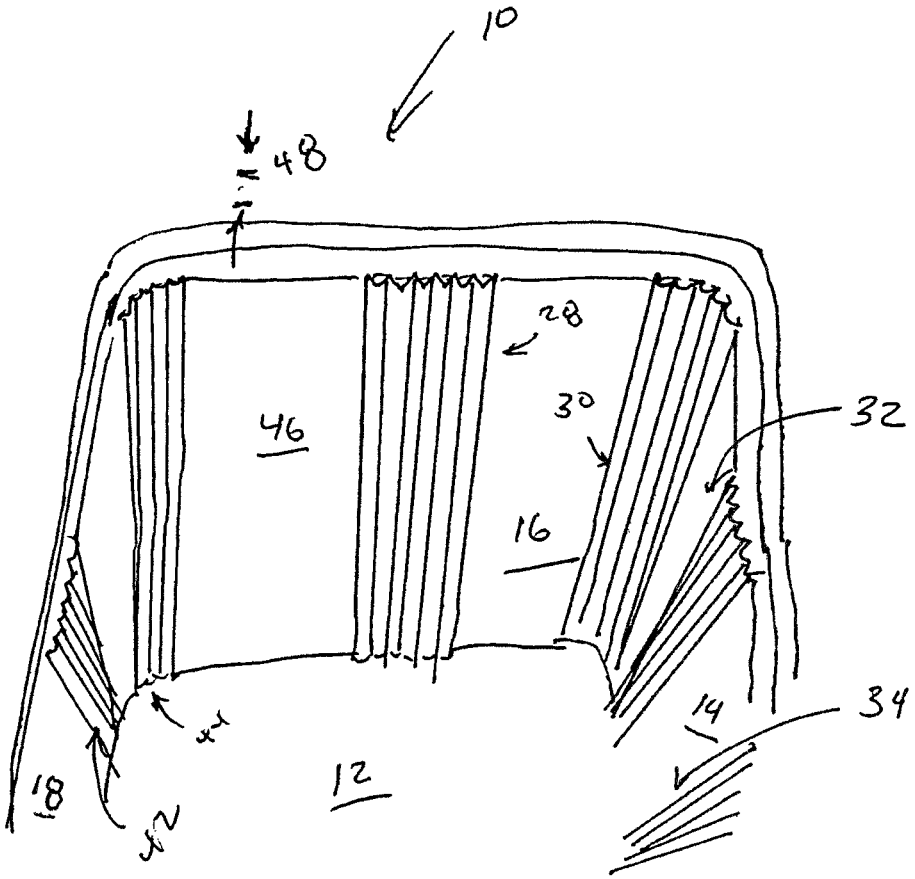
FIG. 2 is a top perspective view of the presently preferred embodiment of the present invention.
Figure 3:
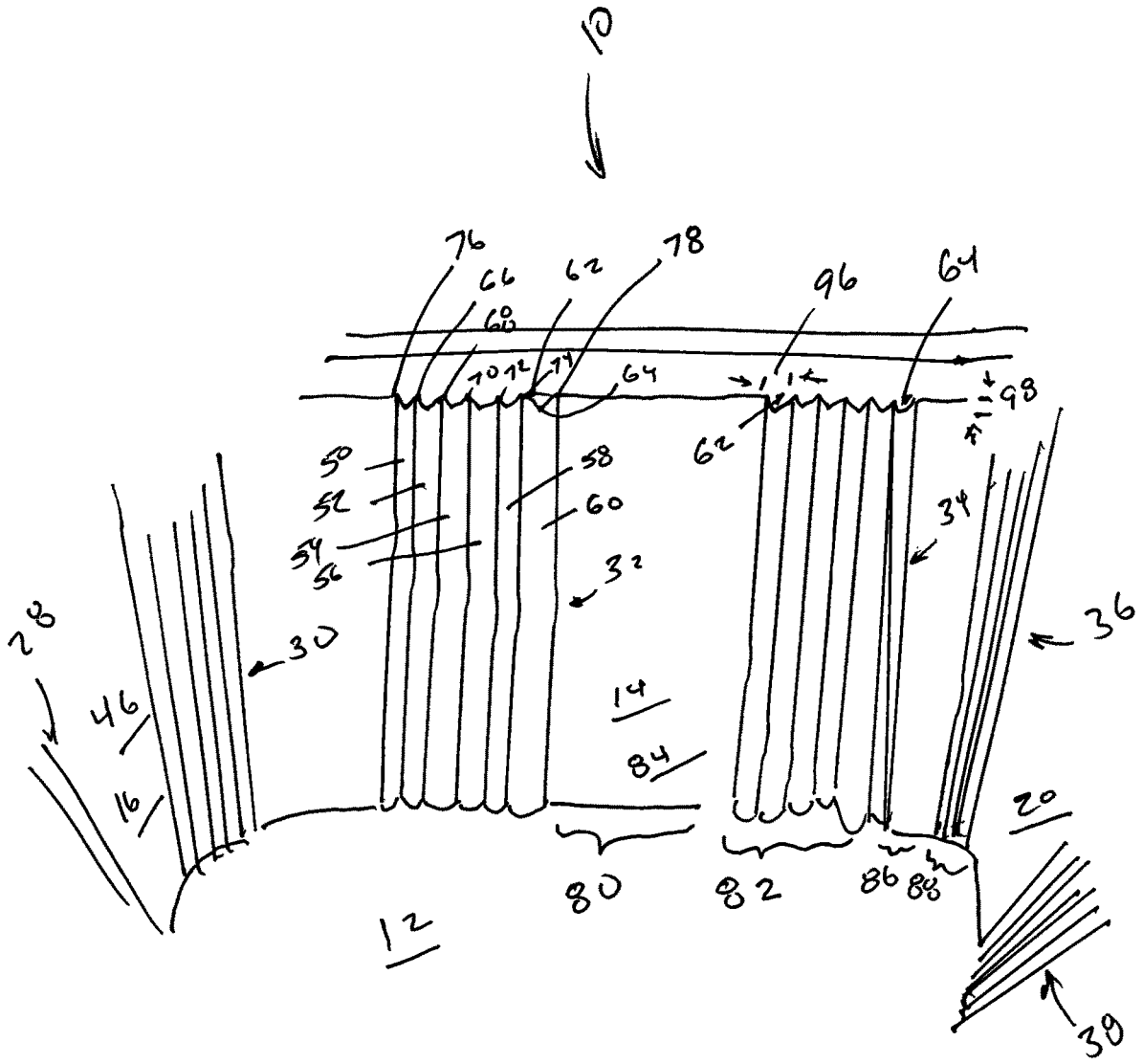
FIG. 3 is a top perspective view of the presently preferred embodiment of the present invention.

FIGS. 1, 2 and 3 show a container 10 according to a first embodiment of the presently preferred invention. FIG. 1 shows the container 10 from a side view. The container 10 has a base 12 from which extend at least one if not a plurality of sidewalls 14,16,18 and 20. Of course, a round container 10 may have a single continuous sidewall 14 that is somewhat cylindrical or even have other shapes. Sidewalls 14,16, 18 and surround an internal cavity 20 which terminates at an uppermost edge 24 which may be co-planar or slightly elevationally above an internal edge 26 (if not even be the same structure for various embodiments) (cavity 20 forms a contained volume above the base 12 internal to the sidewalls 14-20). With reference to the figures, one will see a series of pillars 28, 30,32,34,36,38,40 (obscured from view), 41 (obscured from view) 42,44 which are all spaced apart preferably by thin walled portions 46 which are preferably planar for the illustrated embodiment but could have a radius of some sort for other embodiments.

Pillars 28-44 are of two basic types as shown and described in the illustrated embodiment. First there are wall pillars 28,32,34,38,41,42. The wall pillars 28,32,34,38,41, 42 are located along planar portions of sidewalls 12,14,16, 18, 20. They are spaced by thin wall portion 46 which preferably has a constant thickness 48 as it relates to the thickness across the sidewall 14,16,18,20 particularly as it relates to the thickness as it may extend into the internal cavity 22. The wall pillars 28,32,34,41,42 preferably extend at or about at the base 12 (often towards the base) vertically upwardly to the internal edge 26 if not the upper edge 38 of the sidewalls 14,16,18,20. In addition to the side pillars 28,32,34,38,41,42, there are also corner pillars 30,36,40,42 for at least some embodiments.

Some embodiments have both wall pillars 28,30,32,34, 38,41,42 and/or corner pillars 30,36,40,44. Some may have corner pillars 30,36,40,44 and/or side pillars 28,32,34,38, 41,42. Some embodiments may have both. Each of the pillars 28-44 may be comprised of a series of supports such as 50,52,54,56,58,60 which are preferably vertically extending members which have a thicker cross-section than thin walled portions 46 represented by thickness 48. In fact, the pillars 50-60 may have a tapering cross-section extending beyond thickness 48 such as from a wider shoulder 62 to a narrower face 64 so as to have a somewhat additional triangular and/or rounded cross-section then the walled portion 46 as the supports 50-60 extend into the internal cavity 22. This cross-section may be continuous from towards the internal edge 26 down towards the base 12 if not to the base 12.

One of ordinary skill in the art will also see that the supports 50-60 are also adjacently spaced by spaces 66,68, 70,72,74 which may begin at thickness 48 and may be spaced apart by sidewall portions 46 by spaces 76,78 which could separate out not only the supports 50-60 from one another but also the pillars 28-44.

As discussed above, the supports 50-60 are preferably thicker than the thickness 48 of the sidewall portion 46 which separate the pillars 28-44 so as to space them apart. For many embodiments, the width 80 may have a spaced apart portion 82 maybe as wide as or wider than the width 82 of an adjacent pillar 34. Other embodiments may have the width 80 less than the width of the width 82 of the pillar 34 but be approximately similar thereto such as width 86 being somewhat similar to width 88 as illustrated in FIG. 3. As opposed to many prior art embodiments which utilize a corrugated structure about the sidewalls, the intermittent use of pillars 28-44 thereby allows the applicant to use less material than prior art structures.

While the entire container 10 may be molded as a single injected molded part, other embodiments may have an internal liner 90 within an outer shell 92 to facilitate use of molding for at least some embodiments although for the preferred embodiment a unitary mold for a unitary container 10 may be utilized. With many constructions, the exterior surface 94 of sidewall 18 as well as the other sidewalls 14,16,18,20 can be substantially smooth as it relates to the pillars 28-44.

Thus, one of ordinary skill in the art will quickly see that the pillars 28-44 provide some additional material to provide strengthening ribs internal to the internal cavity 22 of the container 10 for many embodiments.

As it relates to the corner pillars, 30,36,40,44 some embodiments may be sufficiently strong with just corner pillars 30,36,40,46. Other embodiments may be sufficiently stiff with just wall pillars 28,32,34,38,41,42. Still other embodiments may have both sets of pillars 28-44 as illustrated. Each of the pillars utilized 28-44 and/or others preferably provide increased stacking strength for the container 10 while minimizing the thickness 48 of the sidewalls 14-20 particularly the sidewall portions 46,84 and/or others. In fact, for may embodiments, the base 62 of each of the supports 50-60 can extend from the same thickness 48 as it relates to the internal cavity, i.e., to be co-planar with the sidewall portion such as 26,84 etc. and then extend into the volume of the internal cavity 22 in a narrowing fashion such as towards a point around portion 64 etc. Use of a triangular cross-section relatively supports 50-60 can be utilized with a minimal amount of material to provide a significant amount of support.

As one can see that the width 96 the base 62 may be greater than a width 98 of the extension 64 extending into the internal cavity 22 of the container 10. Thus, the total volume of plastic occupied by the supports 50-60 is particularly minimal while sufficiently strong.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A container comprising:

a solid base having upwardly extending continuous sidewalls forming an internal cavity therein defining a contained volume:

said sidewalls each terminating respectively at an uppermost edge;

spaced apart pillars extending with a consistent cross section upwardly from the base to the uppermost edges of the sidewalk, said pillars having at least a portion with a greater solid cross-sectional thickness and volume than thin walled portions of the sidewalls spacing apart adjacent pillars said pillars comprised of a plurality of parallel and adjacent supports, each support extending vertically along the sidewalls from a thickness of the sidewall radially and then back to the thickness of the sidewall; and wherein the supports are spaced apart by a thickness of the thin walled portions separating the pillars and are solid and thicker at the sidewall and taper in cross section as they extend inwardly into the cavity.

2. The container of claim 1 wherein the supports are triangular in cross section.

3. The container of claim 2 wherein a width of the base is greater than a thickness of the supports extending into the cavity.

4. The container of claim 1 wherein the thin walled portions have a constant thickness intermediate adjacent pillars and at least some of the outer surfaces of the thin walled portions and at least some of the pillars are continuously planar.

5. The container of claim 1 wherein the pillars are located at corners of sidewalk meeting at one of a curve and an angle.

6. The container of claim 1 wherein the pillars are disposed along one of planar and curved wall portions of the sidewalk.

7. The container of claim 1 wherein the pillars extend from one of at and near the base to an upper internal edge.

8. The container of claim 7 wherein the pillars extend. to an upper edge of the sidewalls.

9. A container comprising:

a solid base having upwardly extending continuous sidewalls forming an internal cavity therein defining a contained volume:

said sidewalls each terminating respectively at an uppermost edge;

spacer apart pillars :ndiia with a consistent ewss section upwardly from the base to the uppermost edges of the sidewalls, said pillars having at least a portion with a greater solid cross-sectional thickness and volume thin walled portions of the sidewalls spacing apart adjacent pillars said pillars comprised of a plurality of adjacent supports, each support extending from a thickness of the sidewall radially and then back to the thickness of the sidewall; and wherein the supports are thicker at a base at the sidewall and taper as they extend inwardly into the cavity.

10. The container of claim 9 wherein the supports are triangular in cross section.

11. The container of claim 10 wherein a width of the base is greater than a thickness of the supports extending into the cavity.

12. The container of claim 9 where the supports are parallel to one another.

13. The container of claim 9 herein a width intermediate pillars is at least as wide as the width of the pillars.

14. The container of claim 1 wherein the pillars are internally directed from the sidewalls, said sidewalls having a smooth exterior surface.

* * * * *